United States Patent [19]

Mills

[11] Patent Number: 4,953,337

[45] Date of Patent: Sep. 4, 1990

[54] METHOD AND APPARATUS FOR CONSTRUCTING A MASONRY STRUCTURE

[76] Inventor: Ronald L. Mills, 2338 Bolton Rd., N.W., Apt. 12, Atlanta, Ga. 30318

[21] Appl. No.: 130,015

[22] Filed: Dec. 8, 1987

[51] Int. Cl.[5] ..... E04F 13/08

[52] U.S. Cl. ..... 52/385; 52/387; 52/747; 222/611.2

[58] Field of Search ..... 52/49, 385, 386, 387, 52/388, 389, 415, 747

[56] References Cited

U.S. PATENT DOCUMENTS

| | | | |
|---|---|---|---|
| 2,011,510 | 8/1935 | Ackenbrack | 52/385 |
| 3,533,206 | 10/1970 | Passeno, Jr. | 52/391 X |
| 3,672,112 | 6/1972 | Sions et al. | 52/387 X |
| 4,043,487 | 8/1977 | Price | 222/611.2 X |
| 4,236,367 | 12/1980 | Wilczynski | 57/747 X |
| 4,662,140 | 5/1987 | Porter et al. | 52/385 |

*Primary Examiner*—David A. Scherbel
*Assistant Examiner*—Creighton Smith

[57] ABSTRACT

An apparatus for constructing a masonry structure comprises a rigid backing panel with rows of rectangular openings formed therein. Attached to the backing panel and extending outwardly therefrom is a wire structure formed to define a plurality of brick receiving compartments substantially overlying the openings in the panel. The compartments are sized and arranged to accept a plurality of bricks and support them in spaced relationship. A mortar applying tool having a nozzle extending in the space between the bricks and rollers adapted to roll on the surface of the brick adjacent the space is used to fill the spaces between the brick with mortar while simultaneously sculpting the exposed portion of the mortar in the shape of the end of the nozzle.

7 Claims, 3 Drawing Sheets

METHOD AND APPARATUS FOR CONSTRUCTING A MASONRY STRUCTURE

TECHNICAL FIELD

The present invention relates to construction methods and apparatus and, more particularly, to an apparatus and method for constructing a reinforced brick or masonry structure.

BACKGROUND OF THE INVENTION

In the construction of masonry structures such as, for example, brick siding or walls for houses, it is common for the structure to be erected by masons who normally set each brick individually by hand. This process is both intricate and time consuming and requires the skills of an experienced mason. The quality of construction and the uniformity of the completed structure varies with the skill of the mason, and even in structures built by the most skilled masons, individual bricks are not always precisely aligned within the structure. In addition, extensive and time consuming clean up using acids is often required upon completion of the structure to remove excess mortar from the face of the structure.

Attempts have been made to reduce the time and skill required to produce high quality brick structures. Patent No. 3,236,924 of McClarney et al discloses a brick construction aid having rods that extend through the holes in the brick. The brick is supported in spaced relationship vertically by brick supporting flanges formed in the rods and the rods are spaced apart to provide space between individual bricks in the horizontal direction. When the rods have been loaded with brick, mortar is pumped into the space between the bricks to form an integral brick structure.

The device of McClarney, while reducing the skill required to construct a masonry structure, is complicated and time consuming to use. Each brick must be slid onto the rods and supported on the proper flange. In addition, the McClarney device is not usable with solid brick or stone and clean up of the completed structure can still be required. Since the support rods of the McClarney device are removed upon completion of the structure, no reinforcement is provided by the device and reinforcement such as wire embedded in the mortar must be added separately by the mason.

A need exists for a masonry construction aid that will dramatically reduce the time and skill level required to construct a masonry structure while providing for a uniform and reinforced structure of high quality construction. It is to the provision of such a device and a method for using the device that the present invention is primarily directed.

SUMMARY OF THE INVENTION

The present invention is a template or jig for use in the construction of masonry structures such as, for example, brick walls, and a method of using same. The jig comprises a support panel of sheet metal or other suitable material to which is attached a wire structure extending outwardly from the panel a distance slightly greater than half the depth of, for example, a brick. The elements of the wire structure cooperate to define a plurality of brick receiving compartments sized and arranged such that when adjacent compartments are filled with bricks, mortar receiving spaces are defined between successive bricks.

In use, the jig is attached with nails or screws to a structure to be bricked such as the wall of a building. Alternatively, two jigs can be connected back-to-back if desired for constructing cavity walls. After the jig is secured in place, the brick receiving compartments defined by the wire structure are filled with bricks to form the basic structure. The spaces between the bricks are then filled with mortar using a mortar tool having a nozzle that extends into the space between the bricks and two wheels that roll along the surface of the brick on either side of the space. The nozzle is in turn connected through a hose to a conventional mortar pump that provides mortar under pressure through the nozzle and into the space between the bricks.

The end portion of the nozzle is formed to have one of a number of mortar finish shapes such that as the spaces are filled with mortar, the exposed portion of the mortar is shaped by the end of the nozzle. In addition, mortar does not spill onto the face of the brick so that subsequent acid cleaning of the structure is not required. Conventional shapes of the nozzle end such as rounded, square, and tapered can be provided as well as shapes that are not achievable with a conventional trowel or scratch jointer. The wire structure portion of the jig remains embedded within the mortar upon completion of the structure providing exceptionally strong reinforcement for the finished structure. The end result is a reinforced brick structure of considerable uniformity having clean, uniformly shaped mortar joints.

Thus, it is seen that a method and apparatus for constructing a masonry structure is provided wherein the level of skill and time required to construct the structure is dramatically reduced. The resulting structure is, nevertheless, more uniform and of higher construction quality than structures constructed using traditional methods. In addition, the wires embedded in the mortar between individual bricks provide for a highly reinforced structure and since the mortar is applied and finished in a single operation, no subsequent clean up is required.

Other objects, features, and advantages of the invention will become apparent upon reading the following specification when taken in conjunction with the accompanying drawings.

FIG. *6a* is a side view of the invention showing methods of attaching the jig to an ancillary structure.

FIG. *6b* is a perspective view partly in cross-section showing the lower most jig resting on the support bars.

Figure 7:
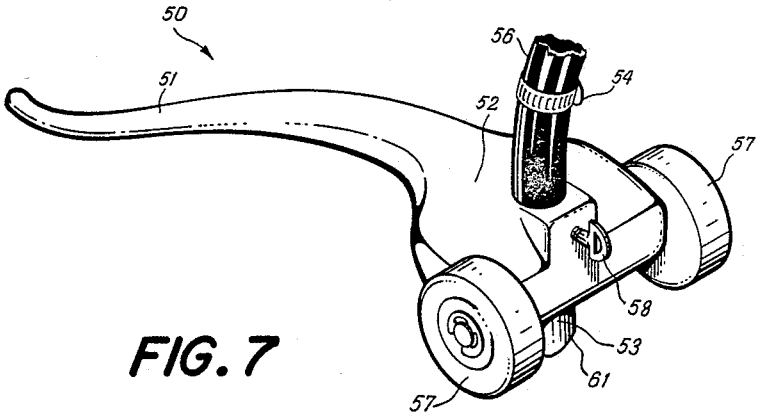

FIG. 7 is a perspective view of the mortar applying tool.

Figure 8:
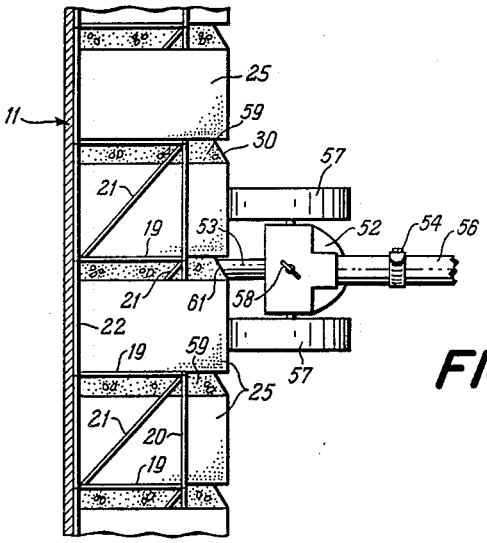
Figure 9A:
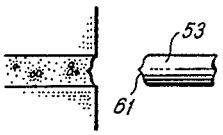
Figure 9B:
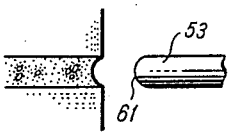
Figure 9C:
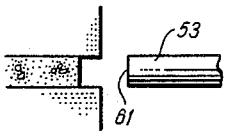

FIG. 8 is a side view illustrating the use of the mortar applying tool to fill spaces between brick.

FIGS. *9a–9c* illustrate alternate embodiments of the nozzle of the mortar applying tool.

DETAILED DESCRIPTION

Figure 1:
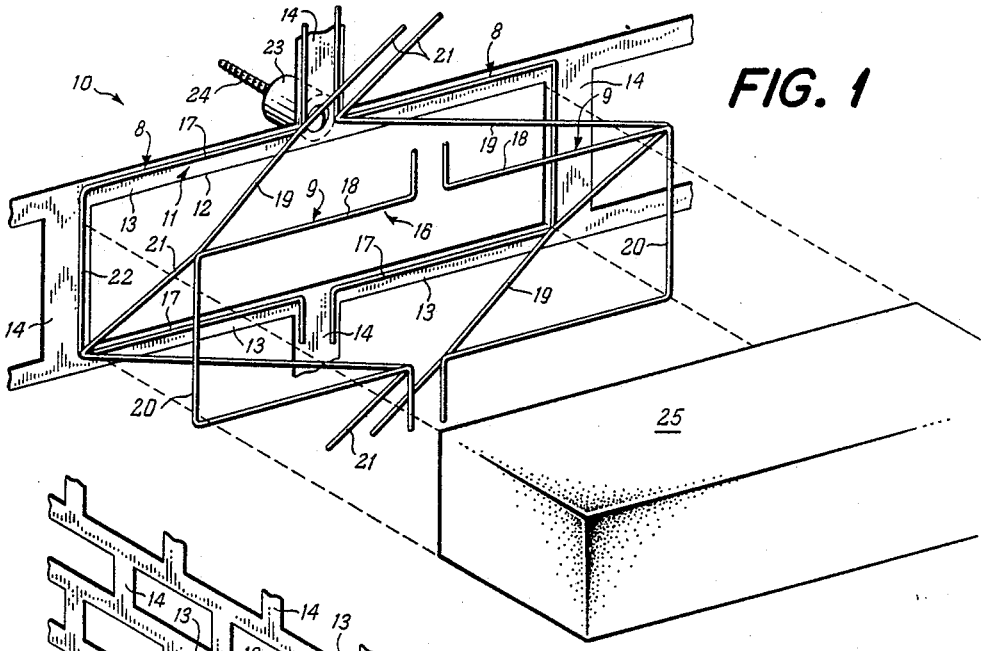
FIG. 1 is a fragmentary perspective view showing the wire structure forming a brick receiving compartment.
Figure 2:
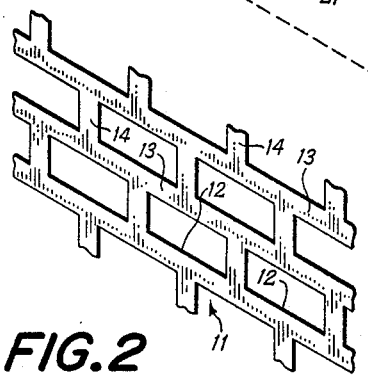
FIG. 2 is a fragmentary perspective view of the backing panel to which the wire structure is attached.
Figure 3:
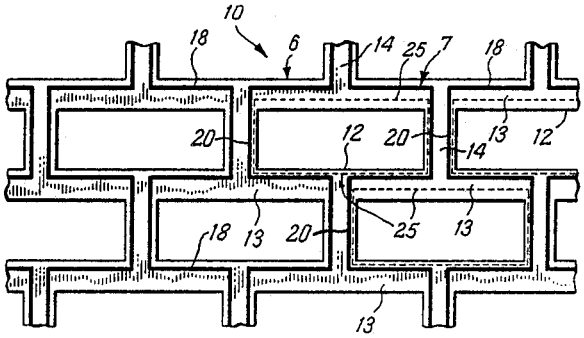
FIG. 3 is a fragmentary frontal view of the invention showing the arrangement of the wire structure and the placement of masonry units.

Referring now in more detail to the drawings in which like numerals indicate like parts throughout the several views, FIG. 1 shows a portion of the masonry jig 10 comprising a backing panel 11 to which is attached a wire structure 16. The wire structure 16 is seen to define a brick receiving compartment sized to accept a brick 25. While only one brick receiving compartment is shown in FIG. 1 for clarity, it will be understood that the pattern of the wire structure 16 is repeated to define a plurality of adjacent compartments as best seen in FIG. 3. The backing panel 11 is formed from a rigid material such as, for example, sheet metal and has formed therein a plurality of rows of rectangular openings 12 as best seen in FIG. 2. In the preferred embodiment, each row of openings 12 is offset from adjacent rows such that horizontal sections 13 and vertical sections 14 are defined in the backing panel.

Wire structure 16 is formed from opposing zig-zag shaped wire portions 6 and 7 (FIG. 3) that cooperate to define the brick receiving compartments. Each zig-zag shaped wire portion comprises a rear element 8 and a front element 9 (FIG. 1). Front element 9 is maintained in spaced relationship with respect to rear element 8 by support members 19 and 21. Rear elements 8 are firmly attached to the backing panel by a suitable method such as, for example, spot welding, such that the brick receiving compartments defined by the wire structure are offset with respect to rectangular openings 12 as seen in FIG. 3. This arrangement allows horizontal sections 13 in the backing panel to extend below the upper surface of a brick resting in a brick receiving compartment such that bricks placed in the compartments abut the horizontal portions 13. Each brick is therefore precisely aligned with the backing panel such that the exposed surfaces of the bricks are flush.

It will be noted from FIG. 1 that support members 19 and 21 extend successively from one corner of rear element 8 to the diagonally opposing corner of front element 9 such that the central portion of each brick receiving compartment is braced or reinforced by two diagonally extending vertical support members 21. Backing panel 11 is attached to a wall or other surface to be bricked by a screw or nail 24 that extends through the backing panel 11 and through a spacer 23 into the wall or other structure. Spacer 23 provides for space between the finished brick structure and the wall to allow for breathing and to comply with many local building codes. Although the attaching means and spacers can be located at any point on the backing panel, they are preferably located adjacent the point at which support members 21 are attached to rear elements 8 of wire structure 16. In this way, the weight of a brick braced by the support members 21 is transferred through the spacer 23 and directly into the wall or other structure to be bricked.

Figure 4:
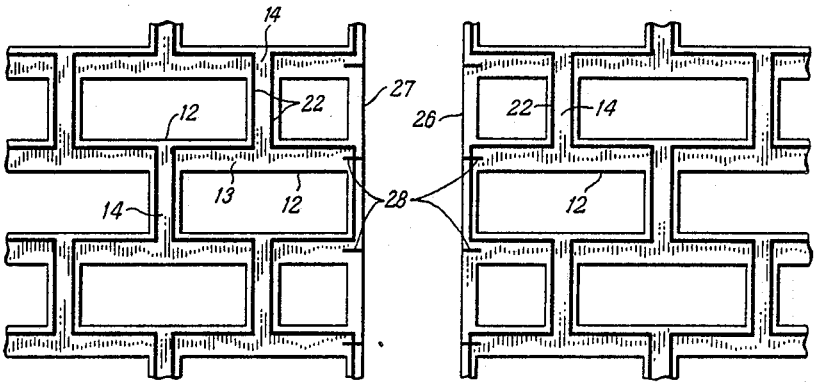
FIG. 4 is a fragmentary frontal view of opposing ends of two masonry jigs showing how they are joined to form a continuous structure.
Figure 5:
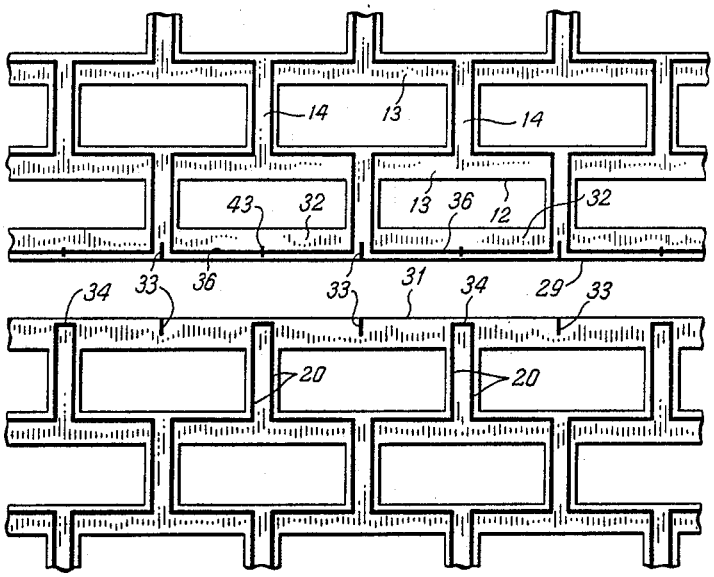
FIG. 5 is a fragmentary frontal view of the top of one jig showing how it is joined to the bottom of a second jig to form a continuous structure.
Figure 6B:
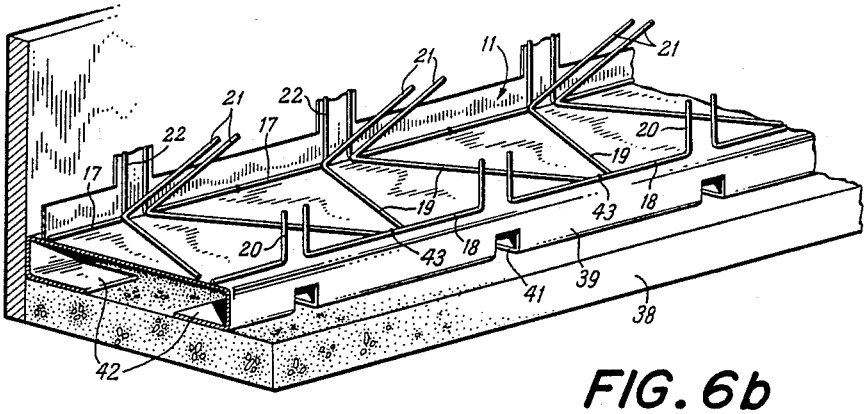
Figure 6A:
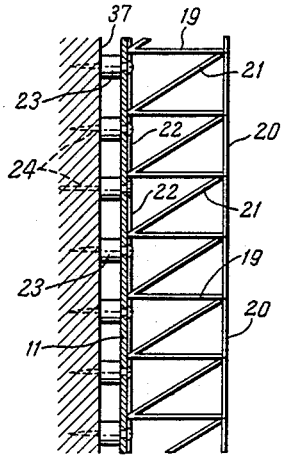

The masonry jig formed by the backing panel 11 and the wire structure 16 preferably has a standard height and width such as, for example, four feet by eight feet. Masonry structures of larger dimensions are formed by joining successive jigs at their ends, tops, and bottoms as shown in FIGS. 4 and 5. As seen in FIG. 4, opposing ends of jigs to be joined are formed with vertical strips 26 and 27 that have widths approximately half the width of vertical portions 14. It can be seen from FIG. 4 that as the edges of two jigs are brought together, their respective wire structures will cooperate to form a continuous array of brick supporting compartments spanning the intersection of the panels. Aligning marks 28 are scored in the end portions of the jig to provide for precise alignment of adjacent jigs.

FIG. 5 shows the top edge of one jig as it is joined to the bottom edge of a second jig to form a continuous structure of increased height. The lower row of rectangular openings 12 is seen to have a decreased width such that the lower horizontal section 36 of the wire structure corresponds substantially to the lower edge of the backing panel. Opposing portions of the wire structure are joined together at 43 in FIG. 5 by a suitable method, such as, for example, welding, to provide for continuous wire structure lower portions 36. The upper edge of each jig is formed as seen in FIG. 5 such that the top of vertical elements 20 are joined together by a wire section 34. Aligning marks 33 are scored in the upper and lower edges of the jigs such that when the jigs are placed together and the aligning marks aligned, a continuous array of brick accepting compartments is formed that spans the intersection of the panels.

FIG. *6a* shows a method of attaching a masonry jig to a structure to be bricked. The jig may be securely attached with screws or nails 24 that extend through the backing panel and through a spacer 23 into the structure 37 providing a space between the structure 37 and the backing panel 11.

As seen in FIG. *6b*, the lower most masonry jig is leveled and supported by support bar 39 which in turn rests on a conventional concrete footing 38 such that the upper surface of the support bar 39 is level. Openings 41 are provided in the support bar 39 such that mortar forced in the space between the lower most row of brick and the footing 38 will flow through openings 41 filling the space inside the support bar 39 thereby forming a secure attachment of the bricks to the footing 38. Flashing made of PVC, rubber or metal can be attached to the structure adjacent the footing and extended between the support bar and the lower most masonry jig providing a water shed for any moisture condensing in the space. In addition, traditional weep holes can be provided by placing small tubes or nails in spaces between lower bricks prior to applying the mortar.

FIG. 7 shows one embodiment of a mortar applying tool for use in filling the spaces between the bricks with mortar. Mortar applying tool 50 is seen to have a handle 51 extending from a support portion 52. The support portion 52 has roller members 57 rotatably attached to opposing sides of the support portion. Mortar nozzle 53 extends through a hole in support portion 52 and can be adjusted such that the end 61 of the nozzle 53 extends a desired distance below the lower surface of the support portion 52. Threaded locking bolt 58 is adapted to be received in a threaded hole extending generally laterally with respect to the nozzle such that the bolt 58 can be tightened against the nozzle maintaining the end 61 of the nozzle 53 at the desired distance below the lower surface of the support portion 52.

FIG. 8 shows the use of the mortar applying tool in filling the spaces between the bricks with mortar. Mortar under pressure is supplied to nozzle 53 through mortar supply hose 56 that is in turn connected to a conventional mortar pump (not shown). The nozzle 53 is adjusted using adjusting bolt 58 such that the end 61 of the nozzle is at the desired depth within the space between the bricks. Wheels 57 are arranged to roll on the exposed surfaces of adjacent bricks with the nozzle end 61 within the space between the brick. With this arrangement, as a workman rolls the tool along the brick at an appropriate rate, the mortar 59 is forced into the space between the bricks 25. At the same time, the exposed portion 30 of the mortar 59 is sculpted by the moving end 61 of the nozzle such that the mortar joint assumes the shape of the end of the nozzle. Thus, filling the space between the bricks with mortar and finishing the exposed portions of the mortar are performed in a single step with little excess mortar spilling onto the surface of the brick.

The end 61 of the nozzle 53 may be formed in any desired shape to produce traditional mortar joints or to produce mortar joints having shapes that are unattainable with traditional trowel finishing techniques. FIGS. *9a–9c* illustrate some examples of nozzle end shapes and the resulting mortar joint finishes.

OPERATION

In using the apparatus of the present invention to construct a masonry structure such as a brick wall, a workman first places the support member 39 on a conventional concrete footing 38 adjacent a wall to be bricked (FIG. *6b*). The support member 39 is leveled in the conventional way such as, for example, by placing shims under the support member and attaching the support member to the footing with masonry anchors. A first masonry jig is placed on the support member 39 and attached to the wall using the spacers and screws or nails as shown in FIG. *6a*. While it is desirable to place spacers adjacent the point of connection of each vertical support member and the rear element 8 as shown in FIG. *6a*, such placement may not be practical in view of the number of spacers required for such placement. Subsequent masonry jigs are attached to the wall adjacent previously attached jigs as indicated in FIGS. 4 and 5 until the wall to be bricked is covered by the attached masonry jigs. Doors, windows and other openings are cut in the panels using conventional tin snips and wire cutters.

After having been attached to the wall, the brick receiving compartments of the masonry jigs are filled with bricks by simply sliding a brick into each compartment until the brick abuts a downwardly extending horizontal member 13 (FIG. 2) of the backing panel. The result is an array of brick having spaces defined therebetween as seen in FIG. 3. Finally, the mortar applying tool is used as discussed to fill the space between the bricks with mortar and to, at the same time, finish the mortar joints in the desired shape. When used properly, the mortar applying tool not only fills the spaces and finishes the mortar, the mortar is confined only to the spaces between the bricks such that little mortar spills onto the brick surfaces and cleaning of the brick as required after traditional bricklaying methods is not required.

The apparatus and method discussed above facilitates the construction of a high quality brick wall in which the individual bricks are precisely aligned and the spaces between the bricks are consistently uniform throughout the entire wall. The resulting wall has the appearance of having been constructed by highly skilled masons when in fact only a fraction of the skill and time invested by such masons is required. While the preferred embodiment illustrates rows of offset brick receiving compartments, it will be understood that other patterns of brick receiving compartments resulting in different brick patterns can be provided. In addition, corner sections can be formed by cutting away a portion of the edge of the masonry jig adjacent the corner and abutting the cut-away edge with the opposing edge of a masonry jig attached to the adjoining wall. Further, the invention can be adapted to produce other masonry structures such as, for example, a cavity wall comprising two layers of bricks separated by a space. Such a cavity wall can be constructed by joining masonry jigs back-to-back with spacers therebetween and following the procedures outlined above for each jig. Also, the wire support structure embedded in the mortar between the bricks provides for extremely strong reinforcement making structures constructed using the jig suitable for jails, vaults, and other applications requiring reinforced walls. Jigs embodying the principles of the invention can be constructed with shapes other than planar, such as, for example, circular to facilitate the building of curved or other shaped masonry structures.

Although the invention has been described in terms of a preferred embodiment to illustrate the principles of the invention, it will be obvious to persons of skill in the art that many modifications, additions and deletions may be made thereto without departure from the spirit and scope of the invention as set forth in the claims.

What is claimed is:

1. A method of erecting a masonary structure adjacent a wall comprising the steps of:

laying a support foundation adjacent the base of the wall;

securing a level support bar to the foundation;

placing a jig defining a plurality of masonry unit accepting compartments adjacent the wall with the bottom portion of the jig resting on the support bar;

placing spacers between the jig and the wall;

placing attaching means through the jig and through the spacers;

securing the attaching means to the wall;

placing masonry units in the masonry unit accepting compartments with the masonry units defining spaces therebetween;

placing one end portion of a nozzle within the space between the masonry units a predetermined distance below the surface of the masonry units with the one end portion having a predetermined shape;

connecting the other end portion of the nozzle to a source of mortar under pressure;

actuating the flow of mortar under pressure through the nozzle and into the space between the masonry units;

moving the nozzle at a predetermined speed within the space between the masonry units in the direction of the space while maintaining the one end portion of the nozzle at the predetermined distance below the surface of the masonry units within the space whereby the space between the masonry units is filled with mortar and the exposed surface of the mortar is sculpted by the one end portion of the nozzle to a shape corresponding to the predetermined shape of the one end portion of the nozzle.

2. An apparatus for use in erecting a masonry structure adjacent a wall, said apparatus comprising:

a substantially rigid backing panel;

means for securely attaching said backing panel to the wall;

support means attached to said backing panel and extending outwardly therefrom with said support means comprising a wire frame structure which defines a plurality of masonry unit accepting compartments adapted to accept and support a plurality of masonry units in spaced relationship;

means for filling the spaces between masonry units positioned within said support means with mortar while simultaneously sculpting the exposed surface of the mortar to a predetermined desired shape;

said backing panel having a plurality of rows of equal sized spaced rectangular openings formed therein with each of the openings in a row being offset from openings in adjacent rows a distance substantially equal to half the length of the openings, said offset openings defining substantially parallel portions of backing panel between adjacent rows of openings and substantially parallel offset portions of backing panel between adjacent openings in each row, and wherein said support means defines masonry unit accepting compartments that substantially overlie said offset openings in said backing panel;

said support means comprising a plurality of zig-zag shaped partitions having horizontal legs and vertical legs, said partitions extending outwardly from said backing panel with adjacent partitions arranged in spaced opposing relationship to define substantially rectangular masonry unit accepting compartments, said compartments having a length substantially corresponding to the length of a masonry unit, a width greater than the width of a masonry unit and a depth less than the depth of a masonry unit and greater than half the depth of a masonry unit whereby masonry units placed into said masonry unit accepting compartments are supported by the horizontal legs of opposing partitions with spaces defined between adjacent masonry units.

3. An apparatus for use in erecting a masonry structure as claimed in claim 2 wherein each of said zig-zag shaped partitions is formed from an interconnected wire structure having a first zig-zag shaped wire attached to said backing panel and a second zig-zag shaped wire of said first wire, said second corresponding to that of having a shape and size zig-zag shaped wire being maintained in spaced substantially parallel relationship relative to said first wire by a plurality of support wires attached to said first and second wires and extending therebetween.

4. The apparatus of claim 3 wherein said support wires extend between diagonally opposing corners of said first and said second zig-zag shaped wires.

5. In a brick wall constructing aid of the type having a plurality of brick supporting compartments adapted to support a plurality of bricks in spaced relationship, an improvement comprising means for filling the spaces between adjacent bricks with mortar while sculpting exposed surfaces of the mortar to a predetermined shape, said means comprising a nozzle defining a passage therethrough and having a first end formed to have a predetermined shape and a second end in fluid communication with a source of mortar under pressure with said first end being adapted to extend into the space between adjacent bricks, said nozzle being attached intermediate its ends to a support member having a handle extending therefrom and a pair of rollers attached thereto, said rollers being spaced apart a distance greater than the space between the bricks and said nozzle being attached to said support member intermediate said rollers, said rollers being adapted to roll along the surface of adjacent bricks with said nozzle first end extending into the space between the bricks whereby mortar flows through the nozzle into the space between the bricks filling the space and the shape end of the nozzle sculpts exposed portions of the mortar to a shape corresponding to the predetermined shape of the nozzle first end.

6. A method of erecting a masonry structure adjacent a wall, said method comprising the steps of:

providing a jig having a wire frame structure which defines a plurality of masonry unit accepting compartments;

laying a support foundation adjacent the base of the wall;

securing a level support bar to the foundation;

placing the jig adjacent the wall with the bottom portion of the jig resting on the support bar;

placing spacers between the jig and the wall;

placing attaching means through the jig and through the spacers;

securing the attaching means to the wall;

placing masonry units in the masonry unit accepting compartments with the masonry units defining spaces therebetween;

placing one end portion of a nozzle within the space between the masonry units a predetermined distance below the surface of the masonry units with the one end portion having a predetermined shape;

connecting the other end portion of the nozzle to a source of mortar under pressure;

actuating the flow of mortar under pressure through the nozzle and into the space between the masonry units; and moving the nozzle at a predetermined rate within the space between the masonry units in the direction of the space while maintaining the one end portion of the nozzle at the predetermined distance below the surface of the masonry units within the space.

7. An apparatus for use in erecting a masonry structure adjacent a wall, said apparatus comprising:

a substantially rigid backing panel;

means for securely attaching said backing panel to the wall;

support means attached to said backing panel and extending outwardly therefrom with said support means comprising a wire frame structure which defines a plurality of masonry unit accepting compartments adapted to accept and support a plurality of masonry units in spaced relationship;

means for filling the spaces between masonry units positioned within said support means with mortar while simultaneously sculpting the exposed surface of the mortar to a predetermined desired shape;

said means for filling the spaces between masonry units with mortar comprises a nozzle defining a passage therethrough and having a first end formed to have a predetermined shape and adapted to extend into the spaces between masonry units and a second end in fluid communication with a source of mortar under pressure, said nozzle being attached intermediate its ends to a support member having a handle portion extending therefrom, said support member having a pair of rollers rotatably attached to opposing sides thereof and spaced apart a distance greater than the space between masonry units, said rollers being adapted to roll along the surface of adjacent masonry units with the first end of said nozzle extending into the space between the masonry units, whereby mortar flowing through the nozzle fills the space between adjacent masonry units as the nozzle moves along the space and the exposed portion of the mortar is simultaneously sculpted by the shaped end of the nozzle to have a shape corresponding to that of the end of the nozzle.

* * * * *